US005712468A

United States Patent [19]

Ace

[11] Patent Number: 5,712,468

[45] Date of Patent: Jan. 27, 1998

[54] MICROWAVE OVEN ILLUMINATION

[76] Inventor: Ronald Ace, 15706 Bond Mill Rd., Burtonsville, Md. 20707

[21] Appl. No.: 457,585

[22] Filed: Jun. 1, 1995

[51] Int. Cl.[6] ..... H05B 6/68; F21V 33/00

[52] U.S. Cl. ..... 219/758; 219/715; 362/92

[58] Field of Search ..... 219/758, 715, 219/716; 362/92

[56] References Cited

U.S. PATENT DOCUMENTS

| | | | |
|---|---|---|---|
| 2,993,973 | 7/1961 | Johnson et al. | 219/758 |
| 3,710,065 | 1/1973 | Crapuchettes | 219/758 |
| 4,211,955 | 7/1980 | Ray | 362/800 |
| 4,219,715 | 8/1980 | Mandle et al. | 219/755 |
| 4,517,432 | 5/1985 | Ishii et al. | 219/755 |
| 4,529,855 | 7/1985 | Fleck | 219/758 |
| 4,795,873 | 1/1989 | Freedman et al. | 219/758 |
| 4,814,952 | 3/1989 | Hammerl | 219/758 |
| 4,855,646 | 8/1989 | Peckitt et al. | 362/362 |

FOREIGN PATENT DOCUMENTS

| | | | |
|---|---|---|---|
| 56-137024 | 10/1981 | Japan | 219/758 |
| 62-52322 | 3/1987 | Japan | 219/758 |
| 1-246785 | 10/1989 | Japan | 219/758 |

*Primary Examiner*—Philip H. Leung
*Attorney, Agent, or Firm*—Jones, Tullar & Cooper, P.C.

[57] ABSTRACT

A high-illumination lighting system for microwave ovens which employs a small, low-voltage microwave-immune incandescent lamp located within the oven cavity, thereby utilizing up to the full 4π steradians of emitted light. The lamp, which may be integrated into the oven cavity during manufacture or may be included in aftermarket ovens as a complete lamp module, preferably is located at the upper front of the oven in order to front-light the over contents. The lamp may be electrically connected to one of several existing oven power supplies, or alternatively, may be an aftermarket module powered by microwave energy within the oven cavity. In the latter case, a microwave antenna is connected to the lamp to supply operating power.

18 Claims, 3 Drawing Sheets

FIG. 1
PRIOR ART
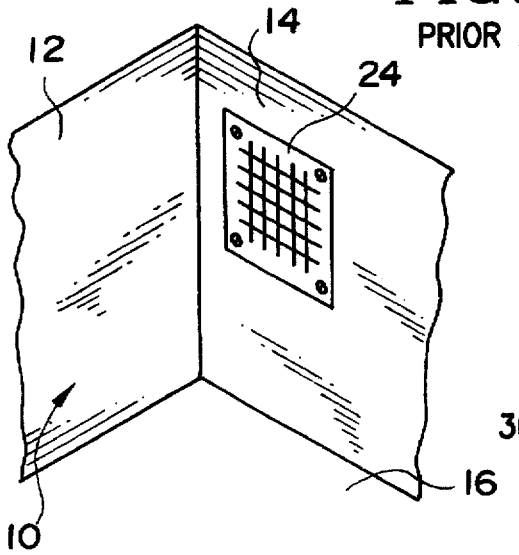
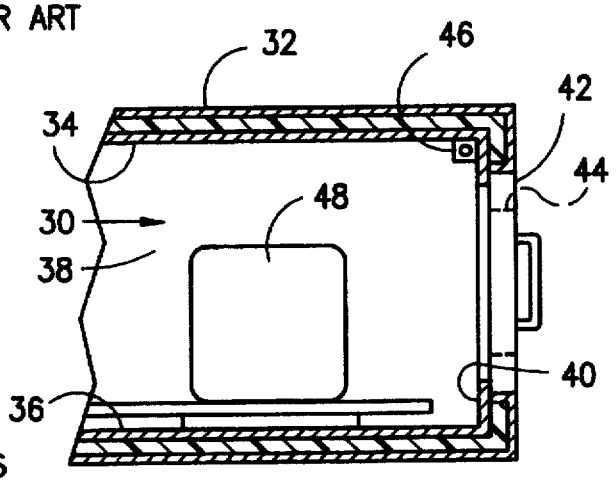
FIG. 3
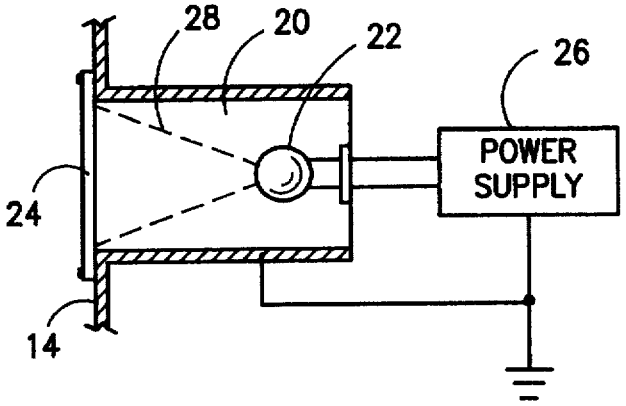
FIG. 2
PRIOR ART
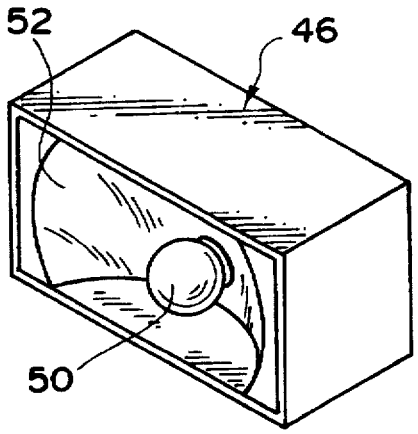
FIG. 4
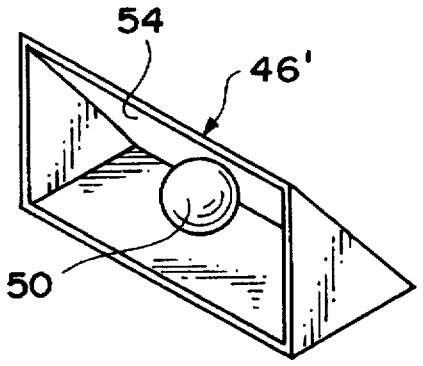
FIG. 4A

MICROWAVE OVEN ILLUMINATION

BACKGROUND OF THE INVENTION

The present invention relates, in general, to a method and apparatus for improved lighting of microwave ovens, and more particularly to improved light sources and the placement of such sources in microwave oven cavities for increased light intensity and improved viewing of the oven contents.

Microwave ovens are in wide use today because of their convenience and relatively small size. Typical home-use microwave ovens have a small interior cooking space, or cavity, which receives moderate quantities of food for rapid cooking. The cavity is illuminated by a small, tungsten filament appliance lightbulb, typically of 25 watts, radiating 200 lumens, and having a life expectancy of about 200 hours. Unfortunately, such bulbs are vulnerable to microwaves, because the filament can receive microwave energy which will heat the filament to destructive levels. Thus, for example, the filament of a typical 25 watt lightbulb operating on 120 volts AC will draw about 0.2 amperes. However, currents approaching and even exceeding this current level can be induced in the filament when the bulb is exposed to microwave power. When this induced current is added to the current flow in the filament when the bulb is turned on, the total current may far exceed the rated value for the filament, causing the bulb to quickly burn out. The problem is made worse if the bulb is used in one of the newer combination microwave/convection ovens in which the temperature within the oven can rise to, for example, 400° F. This oven temperature, when added to the heating effects of the microwaves in addition to the heating effects of the AC current supply can quickly raise the filament temperature above its rated value.

In order to prevent the problem of microwave damage to filament lamps, it has been the usual practice to locate the appliance lightbulb in a small chamber formed in one of the side walls of the oven cavity and to cover the chamber and bulb with a screen to prevent microwave energy from reaching the bulb filament. Unfortunately, the result of such a placement of the bulb is a severe reduction in the amount of available light. For example, only a small fraction of the generated light from the bulb will actually reach the screen, and the protective shield may transmit only about one half of the light falling on it from the bulb. Calculations show that as a result, only about 4 percent of the light available from the bulb actually reaches the oven cavity. Much of this remaining light is lost in the cavity by absorption on the diffuse oven walls and oven contents so that the result is a very dimly lit cavity. To make matters still worse, viewing windows provided on the access doors for microwave ovens typically include microwave-impervious screening which reduces the amount of light that can pass through the window. The end result is that in a typical oven, less than 0.3 foot candles of light will actually exit the oven through the oven window from a 25 watt bulb, and this level of light is far below the minimum required for accurately discerning images and colors.

For example, to achieve good color rendition, a light source should produce a spectral continuum with visual intensities of about 10 candle power. High temperature incandescent lightbulbs are capable of producing this under normal conditions. However, when light intensity is low; for example, much less than 10 candle power, true colors cannot be detected by the human eye. Photopic vision employs color detectors on the retina ("cones") which are relatively insensitive to light as compared to the retinal "rod" detectors which are considerably more sensitive but are completely color blind. It is for this reason that "night vision" is known to produce color errors at less than 10 foot candles of light intensity, with normal vision becoming essentially color blind below about 0.5 foot candles.

Another problem with the low light level in conventional microwave ovens is the contrast between the light in the oven and ambient light in the room in which the oven is located. If, for example, the oven is used in a well-lighted room of ten or more foot candles light intensity, a relatively dark (0.3 foot candle) oven cavity will have an undesirable contrast ratio of less than 1:0.03, making the oven cavity nearly invisible. Ideally, the ratio should be at least 1:1; that is, the oven light should be nearly as bright or brighter than the room light for good viewing of the contents of the oven. Therefore, microwave ovens should, instead of emitting 0.3 foot candle of light at the viewing window, should provide a much greater intensity; i.e., should provide at least 10 foot candles, and preferably between 10 and 30 foot candles.

In order to increase conventional oven illumination to the foregoing levels using prior art incandescent lighting, it would be necessary to install lightbulbs of at least 750 watts, and up to thousands of watts. This could not be done, of course, in view of the limited power available for conventional home type microwave ovens. Such ovens typically are limited to 1,620 watts (13.5 amps) and any power used by the lightbulb is not available for cooking. A major purpose of microwave ovens is the ability to provide high speed cooking and accordingly increasing the wattage of the lightbulb with a consequent decrease in the cooking power available is not acceptable.

Although dimly-lit microwave ovens have been accepted by consumers because of a lack of alternatives, there is a growing need for improved lighting, particularly with the advent of ovens which are capable of providing browning of foods. Food browning is an effect which usually takes place rapidly near the end of the cooking cycle, with the result that food can be over-browned and burned in a very short time if the food is not carefully watched. This implies the need to frequently inspect the cooking the process, but the weak illumination available with present ovens, and the resulting poor color rendition, makes it extremely difficult to monitor the browning process through the oven window. This requires constant opening and closing of the oven door to inspect the food, resulting in loss of heat and slower cooking and browning. Much brighter illumination within the cavity would allow accurate food inspections through the oven window without these frequent door openings and thus without loss of oven heat.

SUMMARY OF THE INVENTION

It is, therefore, an object of the present invention to provide an improved microwave oven light source which will greatly increase the available illumination within the oven cavity without reducing the power available for the cooking operation of the oven.

Briefly, the present invention solves the foregoing problems by providing a high-intensity light within the cooking cavity of a microwave oven or a combination convection/microwave oven, so that the contents of the oven are fully illuminated with an intensity sufficient to provide a good contrast ratio for viewing the contents through the access window. This is accomplished by placing a lamp within the cavity, rather than in a separate chamber, by locating it at the front of the oven at or near the top so that the contents are front-lit for maximum illumination, and by providing a lamp that is relatively unaffected by microwaves. This allows the lamp to be placed in the path of the cooking microwaves, but does not result in damage to the lamp so that the protective screen can be omitted to allow the maximum amount of light from the bulb to reach the oven contents.

To accomplish the foregoing, in a preferred embodiment, a miniature shatter-resistant quartz halogen lightbulb, which is powered by less than about 5 to 10 watts, is mounted on the ceiling, or top surface of a microwave oven cavity at or near the front of the oven, preferably above the access door. If desired, the lamp may be positioned on the door itself, near the top. Such a location eliminates shadows and produces front-lighting of the oven contents. Compared to prior art lamp locations, the frontal illumination provided by the present invention can by itself increase visual acuity 2 to 5 times, for frontal illumination generally is perceived as being brighter and therefore more colorful than side illumination. Quartz halogen lightbulbs are extremely shatter resistant, and thus are unlikely to be adversely affected by liquids being splashed during the cooking process; however, for added safety such a bulb may be contained within a transparent netting, if desired.

Although sufficient intensity is generally available, in accordance with the present invention, without the need for a reflector for the lamp, in some cases it may be desirable to provide a small reflector behind the lamp to shape the light. Such a reflector would direct the light relatively uniformly throughout the food zone within the oven cavity, which is generally rectangular. By concentrating the available light on the food, instead of flooding the oven walls and ceiling, a significant increase in the intensity of light directed to the contents of the oven is provided. This further reduces the wattage of the lightbulb necessary to produce a given contrast ratio between the light within the oven and the ambient light outside the oven. Thus, for example, a miniature lamp in combination with a small compound parabolic reflector might have dimensions of less than 1 cubic inch, similar to the size of a small flashlight, while providing considerably greater illumination to the oven contents than conventional lamps. It will be understood that the reflector can be formed in the wall of the oven, if desired, or may be a separate unit attachable to the wall.

Another aspect of the invention is the provision of a lamp having a filament which is physically small relative to the wavelength of the microwaves supplied to the oven. The filaments of conventional tungsten lamps are relatively long, with a small diameter in order to provide a sufficiently high resistance to operate with a 120V power supply. The length of the filament, however, makes it susceptible to induced RF currents in a microwave oven which can cause the total filament current to exceed its rated capacity, thus burning out the filament. This is overcome, in accordance with the present invention, by utilizing a lamp having filaments which are, for example, 10 to 40 times shorter than conventional tungsten filaments, are much thicker than conventional filaments to withstand higher currents, for example about 1 amp, and which operate at low voltages, preferably in the 3 to 12 volt range. Such a lamp is positioned in the oven cavity so that its filament is very close to the grounded cavity walls to thereby avoid some of the microwaves, and it has been found that such a filament survives exposure to even intense microwave cavity power. In addition, the filament may be physically arranged within the lamp envelope in such a way as to cancel "antenna resonance" effects when the filament is exposed to microwave power, thereby protecting the filament from excessive temperature increases. The power leads to the lamps preferably incorporate an RF choke, using, for example, ferrite beads, inductors in the power leads, or capacitive filtering to reduce residual microwave leakage from the power leads. Preferably, one of the lamp leads is directly connected to the grounded oven cavity itself so that only one lead is required for connection to the power supply. It is further preferred that the lamp be a halogen lamp, for increased efficiency.

A still further alternative is the provision of a miniaturized, lowpower, point-source gas discharge, or short arc lamp, wherein the filament is eliminated. Such lamps typically include sharp electrodes spaced about 1 mm which produce a breakdown discharge upon application of a suitable voltage.

The use of a very small lamp located in the oven cavity, as described above, not only has the advantage of increased lighting efficiency, but the resulting reduction in the required wattage for the lamp permits the use of a smaller power supply for the lamp, reducing the over-all cost of illumination and making available a larger amount of power for the primary function of the oven, which is cooking food. The lamp of the present invention can be built into the oven as original equipment using one of the oven power supplies, or the lamp can be fabricated as a separate lighting module for the aftermarket ovens. In the latter case, a small lamp with an integral reflector may be attached to the oven wall adhesively, or magnetically, with the small amount of power required being supplied to the lamp by radiated microwave energy from within the oven cavity. The aftermarket module may incorporate a dipole pickup antenna connected directly to the lamp, or connected through suitable regulating circuits, to supply the required lamp power, without the need for rewiring the oven.

The foregoing oven illumination system results in significantly increased illumination of the contents of a microwave oven, while reducing the power required for the system. This results in better vision as well as increased efficiency of the oven, and provides a more satisfactory product. The act of relocating the conventional lamp from its external light chamber and the consequent elimination of light losses due to the protective screen normally provided permits full use of the light emitted by the bulb and effectively increases the available light by about 25 times for a given bulb wattage. Relocating the bulb at the top front surface of the oven cavity increases by 2 to 5 times more visibility of the food being cooked in the oven, while the use of a suitable reflector to direct more light from the bulb onto the surface of the food increases the illumination another 3 to 8 times, depending on the quality of the reflector. These significant increases in available intensity concentrated on the front surfaces of the oven contents reduces the power requirement for the light source from, for example, 25 watts to about 2 to 8 watts while still giving greatly improved visibility of the oven contents. This reduction in power requirements for lighting makes the power supply less expensive and makes more power available for cooking.

BRIEF DESCRIPTION OF THE DRAWINGS

The foregoing, and additional objects, features and advantages of the present invention will become apparent to those of skill in the art from the following detailed consideration of preferred embodiments thereof, taken in conjunction with the accompanying drawing, in which:

FIG. 1 is a diagrammatic illustration of a portion of a prior art microwave oven cavity;

FIG. 2 is a sectional view of a prior art illumination system of the type used in the oven of FIG. 1;

FIG. 3 is a partial sectional view of a conventional microwave oven utilizing an improved lighting module in accordance with the present invention;

FIG. 4 is an enlarged perspective view of the lighting module utilized in the device of FIG. 3;

FIG. 4A illustrates a modification of the module of FIG. 4;

DESCRIPTION OF PREFERRED EMBODIMENTS

Figure 5:
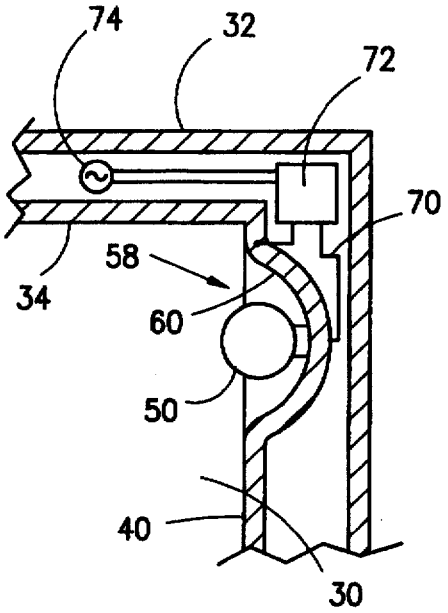
FIG. 5 is a modified lighting module in accordance with the present invention.

Turning now to a more detailed description of the present invention, there is illustrated in FIG. 1 in diagrammatic form a conventional microwave oven cavity 10 having a rear wall 12, a side wall 14 and floor 16. As illustrated, the oven includes an external chamber 20 (FIG. 2) which is located outside the cavity 10; for example behind one of the walls, such as wall 14. A standard appliance-type tungsten filament lamp 22 is positioned in the chamber 20 so as to be out of the path of microwaves within cavity 10, and further protection from the microwaves is conventionally afforded by means of a screen 24 covering chamber 20. The bulb is connected to a suitable AC power supply 26, which may be a winding on the main power transformer for the oven.

Although there may be some reflectivity and scattering of light within the chamber 20, it is the light emitted by lamp 22 within a narrow cone 28 which provides the majority of the illumination at the front of the chamber 20 and at the rear surface of screen 24. The cone 28 represents the light available in one steradian, which is the angle of a solid cone subtending a surface area on a sphere, the surface area having a radius equal to the radius of the sphere. One steradian is the angle subtended by a standard F1 lens which is a lens having a diameter equal to its focal length, but such a lens collects only 1/12 the light available from a point light source. Thus, even if a lens were to be used at the exit region of the chamber 20, behind screen 24, only one steradian of light would be available to the inside surface of the screen, and this is inherently some 25 times less light than is available from the present invention, as will be explained below.

In addition to a reduced amount of light being available from the lamp 22 because of its location in chamber 20, the screen 24 reduces the available light by another 50 percent, so that a 25 watt bulb delivers only about 4% of its emitted light to the oven cavity in a conventional oven. In addition, the location of chamber 20 is generally on a side wall of the oven so that the contents of the oven are side-lit, with the result that a large part of the incident light is not directed toward the oven door, where the viewing window is normally located, thus further reducing the effectiveness of the conventional light source.

In accordance with the present invention, as illustrated in the embodiment of FIGS. 3 and 4, the lamp 22 is removed from chamber 20, and instead a miniature lamp is mounted within the cavity 30 of a conventional microwave oven 32. As illustrated in FIG. 3, the oven 32 includes top and bottom cavity walls 34 and 36, side cavity walls, one of which is illustrated at 38, a rear cavity wall (not shown) and a front cavity wall 40, with an access door 42 having a viewing window 44, shown in phantom, in the center of the access door. A microwave-immune lamp module 46, such as that illustrated in greater detail in FIG. 4, is located within the cavity 30, preferably on or near the front wall 40, and preferably near or at the top wall 34. As shown in FIG. 3, the preferred location is in the center of the upper forward corner of the cavity 30, where the top wall 34 joins the front wall 40. An alternative location would be on the interior surface of the door 42, again preferably near the top edge of the door. This location directs light downwardly and inwardly toward the center of the open cavity 30, illuminating the front (or door) side of the contents of the oven, indicated generally at 48.

The light module 46 may be generally rectangular in cross section, as illustrated in FIG. 4, or may be generally triangular in shape as illustrated at 46' in FIG. 4A to fit into the upper front corner of the oven. The module 46 or 46' may be formed as an integral part of the interior wall of the oven, or, if desired, may be a separate element which is secured in the oven by suitable adhesives, screws or other fasteners (not shown) for easy access and replacement.

The module 46 incorporates a miniature lamp 50 which may be generally spherical, as illustrated, or any other suitable shape. The interior of the module preferably incorporates a reflective surface which may be a compound-parabolic surface 52, i.e., curved about two axes, may be a planar surface 54, or may be any other desired shape for directing light from bulb 50 onto the contents 48 of the oven. The reflector surfaces preferably are curved or directed to reduce the amount of light falling on the interior walls of the oven, thereby reducing losses at those surfaces, and since the entire lamp 50 is within the cavity 30, the entire $4\pi$ steradians of lamp output is available for illuminating contents 48.

As illustrated in FIG. 5, a modified version of the light module, generally indicated at 58, may be an integral part of the front wall 40 of the oven 32, with a reflective surface 60 being an integral part of wall 40 and having a parabolic or other suitable shape. A bulb such as the spherical lightbulb 50 is mounted in the module 58; for example, by way of a suitable dual-pin socket (not shown), with the reflective surface 60 directing light into the cavity in the manner described above with respect to FIGS. 3 and 4. Again, by placing the bulb 50 in the oven cavity 30, essentially all $4\pi$ steradians (i.e., 12.6 steradians) of the light produced by the bulb is available for illumination of the object 48. This provides a significant increase in the available light, thereby permitting a reduction in the wattage of the lightbulb and reducing the amount of power required from the power supply for illumination.

Although it is preferred to have the bulb 50 located directly in oven cavity 30, it may be found desirable to cover the modules 46, 46' or 58 with a fine transparent netting or a transparent fused silica cover plate for safety purposes if the bulb 50 is susceptible to breakage, or for ease of cleaning the lamp module. such a cover plate will not significantly reduce the illumination produced by the lamp, however.

Figure 6:
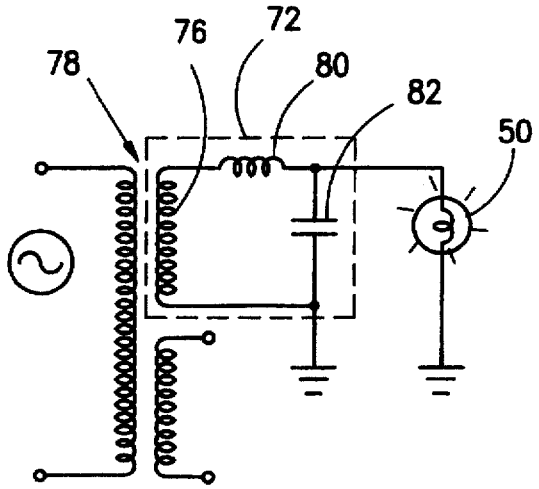
FIG. 6 is a power supply for the lamp utilized in the modules of FIGS. 4 or 5.

As illustrated in FIG. 5, the lamp 50 is connected by way of lead 70 to a suitable power supply 72 which may be connected to a conventional AC source 74. The power supply 72 may, in some cases, be a winding 76 on a main power transformer 78 for the microwave oven (see FIG. 6), the winding 76 supplying power to the lamp through an RF choke 80 and across a filtering capacitor 82. The same power supply may be used for module 46 or 46', as well, in which case the filter elements 80, 82 may be incorporated in the module housing, if desired. It will be apparent that as the power requirements of the lightbulb are reduced, the amount of power available for operating the microwave oven itself is increased.

Figure 7:
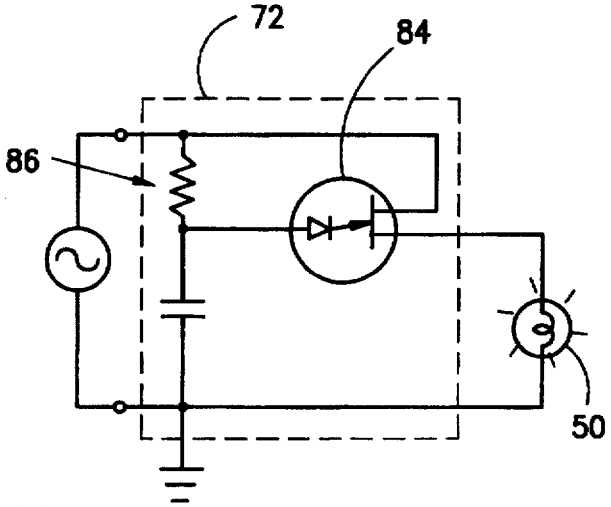
FIG. 7 is a schematic diagram of an alternate power supply for the lamps of FIGS. 4 and 5.

FIG. 7 illustrates a second embodiment of a power supply 72, utilizing a solid state Triac device 84 connected to a source of AC power across an RC circuit generally indicated at 86. This power supply is also suitable either module 46, 46' or 58.

The location of the lamp modules 46, 46' or 50 within the oven cavity 30 exposes the lamp 52 to the microwaves used for cooking. These microwaves normally induce unwanted RF currents in the lamp filament which will quickly burn out a conventional incandescent light bulb. In accordance with the present invention, the incidence of induced RF currents is reduced by the placement of the module in the upper front corner of the cavity, for the interior wall surfaces of the oven cavity are normally electrically grounded, provide some protection from the microwave energy within the cavity. More particularly, however in the preferred form of the invention, the lamp 50 is constructed with filament which is substantially immune to the microwaves. Thus, for example, the filament may have a length of less than about 1/40 of the microwave RF wavelength so that if the low voltage filament used in the lamp is a straight wire filament, its maximum length would be approximately 3 mm. This would prevent induction of damaging RF currents due to ambient microwave energy.

In general, the filament used in lamp 50 must be configured in such a way that RF current induced by microwave energy intercepted by the filament is kept very small compared to the intentional current supplied from the power supply 72. This may be accomplished by reducing the effective length of the filament to thereby reduce induction effects and by increasing the intentional current in the filament. The increased intentional current also allows a reduction in operating voltage for a given lamp wattage. Thus, for example, a 12 watt lamp may include a filament which carries about 4 amperes of current at 3 volts, may have a filament designed to carry about 1 ampere at 12 volts, or may have a filament designed to carry about 0.1 ampere at 120 volts. To prevent overheating of the filament, the microwave-induced current should not exceed a small percentage of the total current in the filament. Thus, for example, if the applied power is to be 12 watts at 120 volts AC, then the maximum induced microwave current in any part of the filament must not exceed, under operating conditions, about 0.01 amp at the microwave frequency in order to avoid RF damage to the filament. One way to ensure such a low induced RF current is to make the filament physically small; for example, by making the length of the above-noted 3 volt, 4 ampere filament equal to about 1/10 the wavelength of the microwave energy in the oven, or by making the 12 volt, 1 ampere filament 1/40 the wavelength of the microwave. However, it is difficult to fabricate a long lasting filament which will withstand a high voltage.

Figure 8:
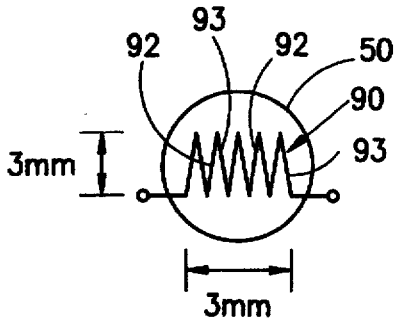
FIG. 8 is a diagrammatic illustration of an alternative lamp filament in accordance with present invention.

RF induced currents are kept small in accordance with one embodiment of the present invention, by constructing a 120 volt filament in such a way that pairs of filament sections are arranged to form a segment, with the two sections of a pair intercepting microwave energy 180° out of phase with respect to each other. The net RF current in the segment then will be near zero, and a multiplicity of such segments may be connected in series with the net RF current in the complete filament remaining near zero. Thus, short RF-nulling filament sections are provided so that each section will not carry an appreciable amount of current induced by the applied RF frequency. The series connection of segments forms a filament that is long enough to permit the application of higher voltage power to the lamp, while being effectively short enough to prevent induction of a significant quantity of RF power. Such a filament 90 is illustrated in FIG. 8, the filament being made up of a plurality of adjacent sections 92 and 93, section 92 being the left hand portion of each segment, and section 93 being the right hand portion of each segment. As illustrated, each section is less than about 1/40 of the RF excitation wave length, i.e., about 3 mm in length, and by providing five such segments, a total filament length of about 30 mm can be obtained with minimal RF current induction.

Rough calculations indicate that the location of the lamp 50 or 62 within the oven cavity 30 to allow the full use of 12.6 steradians of light, compared to the usual 1 steradian, plus the elimination of the protective screen which normally reduces available light by 50 percent, produces a net of 25 times the amount of light normally available from a typical oven lamp. By utilizing a low-voltage halogen lamp, the available light can be doubled without shortening lamp life, and the front lighting of objects 48 within the oven by placement of the lamp in the front upper corner of the oven permits an additional doubling of object illumination. All of these factors allow reduction of light bulb wattage from 25 watts to about 12 watts, and in many cases to less than about 6 watts, while still providing many times higher illumination, and startlingly improved visibility. Since this improved visibility is accompanied by a reduction in power usage for illumination, there is a consequent small increase in the power available for cooking, and an increase in the overall efficiency of the oven. As noted above, this improved illumination within the oven increases the contrast ratio between interior illumination and exterior, or ambient, room illumination, thus improving the visibility of the contents 48 of the oven through window 44.

Figure 9:
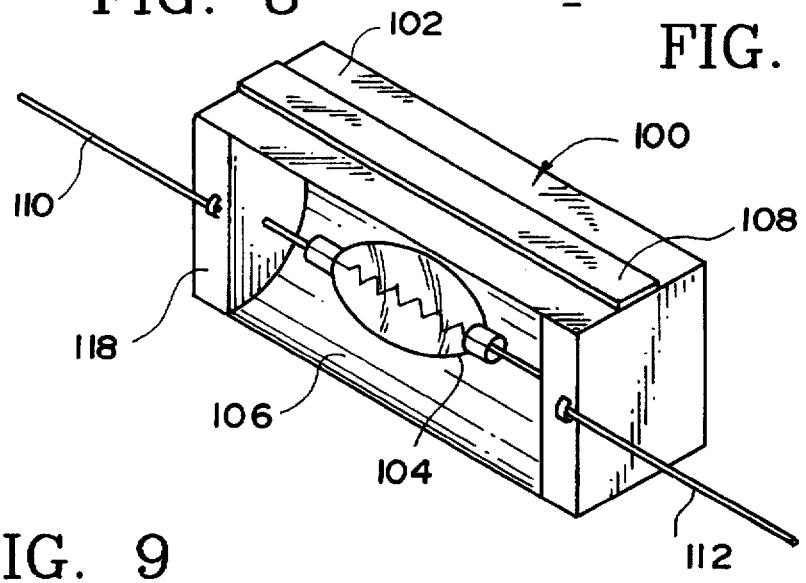
FIG. 9 is a diagrammatic illustration of an aftermarket lighting module in accordance with the present invention.

The foregoing embodiments of the present invention utilize existing powerline power in the oven, and since the manufacturers have access to that source of power, those embodiments are best incorporated in the oven during manufacture. The provision of a simple, low-cost lamp and power supply for preexisting microwave ovens is, however, a more complicated matter, and accordingly the provision of an aftermarket lamp which can be installed in existing ovens is a significant feature of the present invention. The aftermarket lamp of the invention can be installed without requiring customers to disassemble their microwave ovens to locate and connect electrical circuits, mount lamp sockets, and reflectors, and the like. Thus, in accordance with a modified form of the present invention, a self-contained lighting module 100, illustrated in FIG. 9, is provided. This module includes an exterior housing 102 which contains a microwave-immune incandescent lamp 104 and a reflector 106, which is similar to the module described above with respect to FIG. 4. The housing 102 may include an adhesive strip or a magnetic strip 108, for example, on its top surface, for convenience in securing the module in an existing microwave oven cavity, preferably in the location illustrated for module 46 in FIG. 3.

As noted above, a highly regulated, low voltage power source is required to operate a microwave-immune incandescent lamp, and in accordance with the present invention, this source can be obtained for the aftermarket module 100 from the microwave energy in the oven cavity itself. Microwave cavity power density typically varies over a wide range, and is dependent in part on the size of the load presented by the contents 48 of the oven. This can vary the field strength in the oven cavity by a factor of 10 or more, so if the RF energy in the oven is to be used as a source, and minimum lamp power is to be maintained, a regulator must be provided that will handle a wide range of energy levels.

As illustrated in FIG. 9, and in accordance with the present invention, energy is supplied to the lamp 104 by way of a small RF dipole antenna including antenna arms 110 and 112. The dipole antennas may be arranged to extend outwardly from the module 100, in a direction generally parallel to the wall on which the module is mounted, with the dipoles having lengths of approximately ¼ the wavelength of the microwave energy to received. Low RF voltage obtained at appropriate taps near the center of the antenna is rectified, as by a rectifier 114 in FIG. 10, and the DC energy is stored in a small capacitor 116. The capacitively-stored energy is switched to the lamp through switching regulator 118, at a variable repetition rate, so that the lamp always receives the power required for operation. In switching the rectified and stored RF energy, the only real power extracted from the microwave oven cavity will be that which is dissipated by the lamp, plus small losses in lamp power switching, so the RF antenna will not pick up or dissipate more than is necessary to operate the lamp. Such an RF-powered lamp power supply can be produced as a single, low-cost integrated circuit using high speed microwave rectifiers, in known manner. If desired, a varactor circuit frequency divider may be provided in the antenna circuit, as illustrated at 120, to permit the use of a less expensive diode rectifier.

Figure 10:
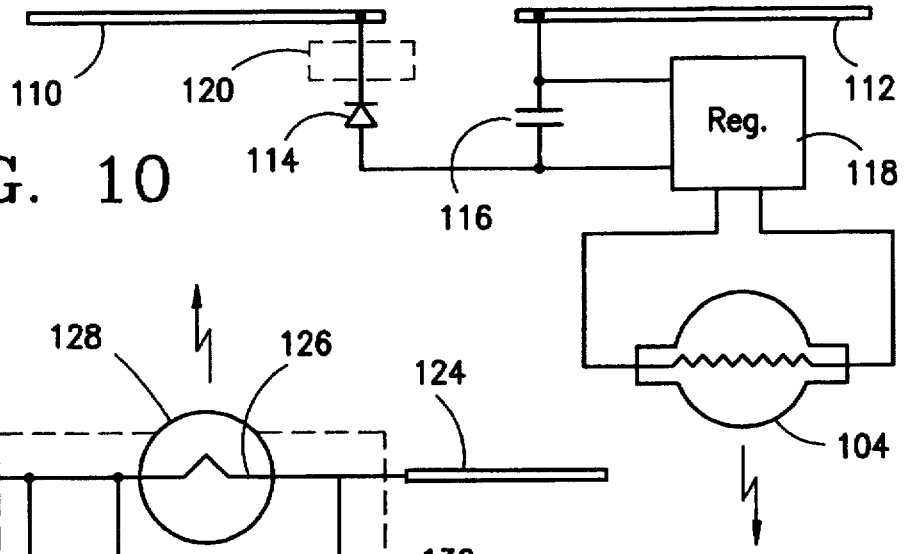
FIG. 10 is a diagrammatic illustration of an energization circuit for the device of FIG. 9.
Figure 11:
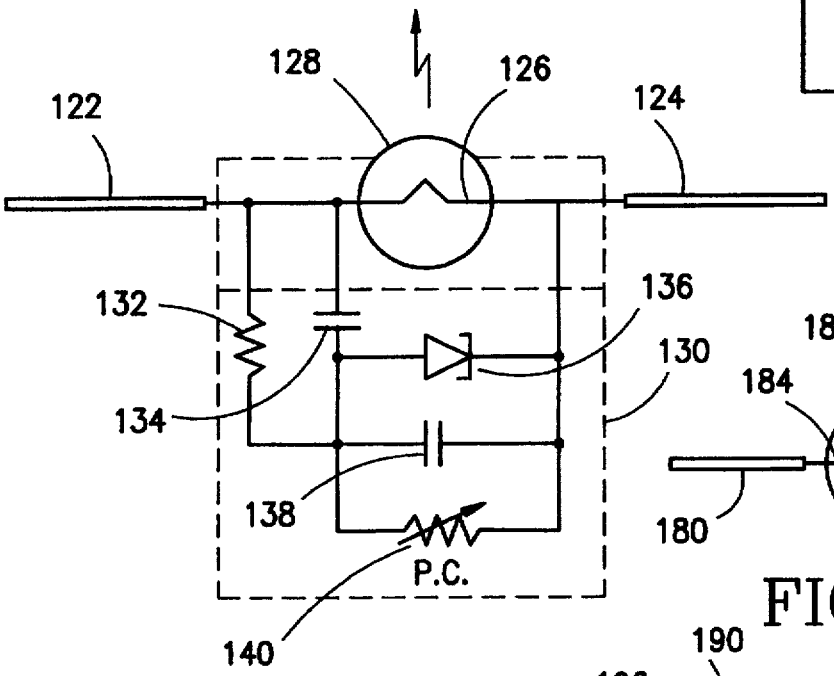
FIG. 11 is a modification of the circuit of FIG. 10.

A modification of the circuit of FIG. 10 is illustrated in FIG. 11 wherein a dipole antenna 122, 124 is connected to opposite ends of a physically small filament 126 of a low inductance incandescent lamp 128. The voltage across the lamp is controlled by a regulator circuit 130 which includes a bypass resistor 132 and a parallel DC blocking capacitor 134 connected to the base of a varactor diode 136, the other end of the diode being connected to the dipole 124. A bypass capacitor 138 is connected across the varactor 136 and a variable resistance photocell 140 is connected in parallel with the varactor and the capacitor 138. The photocell senses the light output from lamp 128 and varies the voltage across the lamp filament to regulate the light output.

Figure 12:
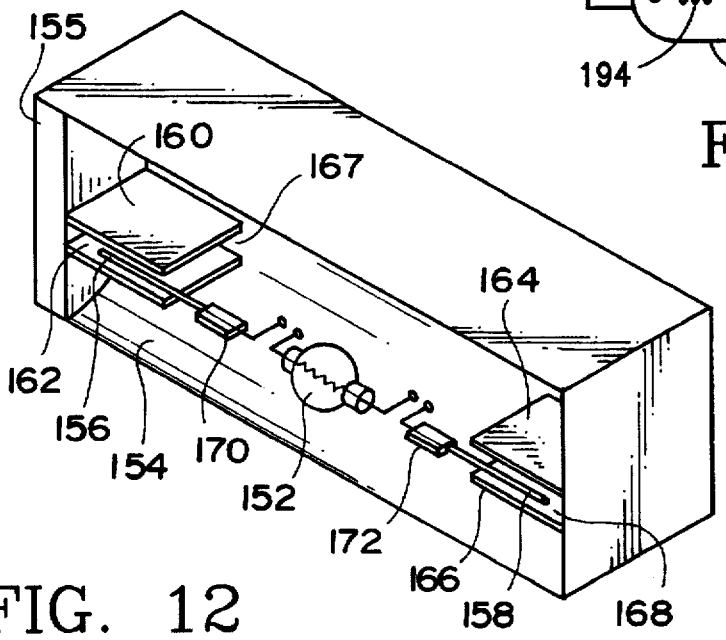
FIG. 12 is another embodiment of the module of FIG. 9.

Another power regulator for an aftermarket lamp is illustrated in FIG. 12. In this embodiment, a module 150 includes a lamp 152 and a reflective surface 154 mounted in a housing 155, as in prior embodiments. In addition, the lamp is energized by the circuitry of FIG. 10 or FIG. 11, which may be mounted inside housing 155 and which is connected to low-mass dipole antenna arms 156 and 158 mounted on module 150. RF attenuators such as shields in the form of parallel plates 160, 162 and 164, 166 are positioned within the module near, and parallel to the dipole antenna arms 156 and 158. The antenna arms may then be moved with respect to the shields, for example toward and away from the gaps 167, 168 between the plates, to regulate the amount of RF energy reaching the antennas, the antenna arms moving into and out of the gaps between the parallel shields as required. Rapid motion of the antenna arms may be automatically effected, for example, by respective bimetallic elements 170 and 172 which are sensitive to heat produced in the elements by the current flow in the antenna arms.

The antenna arms may be very thin wires, having diameters in the range of 0.001 to 0.010 inch, while the bimetallic elements 170, 172 may be high temperature elements so as to be relatively immune to ambient temperatures, while remaining sensitive to current flow produced by RF signals received by the antennas. The plates 160, 162 and 164, 166 preferably are metal plates which are electrically insulated to prevent the antenna arms from short circuiting against the shields. It will be understood that the plates do not have to be parallel; they can be angled as required to provide extremely sensitive regulation of the lamp current flow with only slight motion of the antenna in response to changing temperatures sensed by the bimetallic elements.

If desired, the entire length of the antenna may be a bimetallic element so that the antenna wire can bend along its entire length.

It is noted that the low inductance lamp 128 illustrated in FIG. 11 may also be used in the device of FIG. 12. Such a lamp is preferred since in the later embodiment it consists of an essentially straight wire filament, with only a small degree of bend sufficient to accommodate dimensional changes during heating and cooling.

Figure 13:
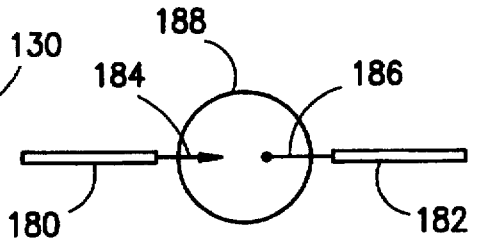
FIG. 13 is a diagrammatic illustration of a point-source arc discharge lamp utilizing a microwave dipole power supply in accordance with the present invention.

The problems encountered with tungsten filaments can be avoided by using a point-source arc discharge lamp connected to a dipole antenna, in the manner illustrated in FIG. 13. In this illustration, antenna arms 180, 182 are connected directly to discharge electrodes 184 and 186, respectively, of a gas discharge lamp 188. An RF power regulator such as that illustrated in FIG. 12 for lamp 128 may be used in conjunction with the gas discharge lamp 188, if desired. The arms 180 and 182 are preferably half wave dipoles which produce a high starting voltage across the discharge electrodes 184, 186 accompanied by low RF current. Once the lamp starts to discharge, the arms 180, 182 form a single full wave antenna which changes the voltage pattern across the lamp, providing a significantly higher current flow which maintains the discharge. The arc lamp is less sensitive to ambient oven temperatures than is an incandescent type lamp, and is even more efficient in generating light than incandescent lamps, thus further reducing the power requirement of the aftermarket lamp module. Gas discharge lamps typically produce very rich UV light which may be useful in microwave ovens to continuously disinfect the oven wall surfaces.

Figure 14:
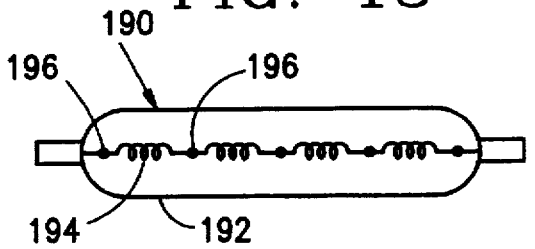
FIG. 14 is a diagrammatic illustration of a modified incandescent bulb in accordance with the invention.

Another modification of the microwave-immune lamp of the invention is illustrated at 190 in FIG. 14, wherein an incandescent bulb 192 includes a filament 194 which is interrupted by a plurality of ferromagnetic beads 196. These beads are spaced along the length of the filament to divide it into a plurality of segments to prevent the induction of RF currents by microwave energy in the oven cavity.

In a test of the present invention, the conventional 120V tungsten filament appliance lamp was replaced by a miniature 12 volt 25 watt microwave-immune halogen lamp by placing the halogen lamp in the upper front corner of the cavity of a 1.6 cubic foot microwave oven. The illumination within the cavity, which was measured with a calibrated light meter through the window and screen mounted in the oven door, showed an increase in the overall illumination within the cavity of from about 0.5 foot candle to about 52 foot candles; i.e., a 100-fold increase in visible light with no increase in the amount of power supplied to the lamp. The test was conducted in a room which had ambient illumination of 10 candle power, but no contrast problems or reflections were noted. Objects in the oven were all visible in fine detail, with almost no obstruction even though the transmissivity of the oven window was less than optimum.

Although the present invention has been described in terms of preferred embodiments, it will be apparent that numerous modifications and variations may be made without departing from the true spirit and scope thereof, as set forth in the following claims.

What is claimed is:

1. A lamp module for insertion in a cooking cavity of a microwave oven to illuminate the cavity, comprising:

a housing;

means for mounting said housing in the cooking cavity of a microwave oven for direct exposure to microwave energy in the cavity;

a low-voltage high brightness lamp mounted in said housing;

a microwave antenna mounted on said housing, electrically connected to said lamp, and responsive to microwave energy in the cooking cavity to supply electrical current to said lamp; and means for regulating the electrical current supplied to said lamp.

2. The module of claim 1, wherein said means for mounting said housing includes means mounting the housing on a cooking cavity wall surface to direct $4\pi$ steradian of lamp output into said cavity for illumination.

3. The module of claim 1, wherein said lamp has a filament which is small in length compared to the wavelength of the microwave energy which supplies said power to prevent direct induction of RF current in the filament, whereby said lamp is substantially immune to microwave energy in the cooking cavity.

4. The module of claim 1, wherein said means for regulating the electric current supplied to said lamp includes means regulating the amount of microwave energy which reaches said antenna to thereby regulate the power supplied to said lamp.

5. The module of claim 4, wherein said means for regulating the amount of microwave energy which reaches said antenna includes a movable antenna.

6. The module of claim 4, wherein said means for regulating the amount of microwave energy which reaches said antenna includes a shield adjacent said antenna.

7. The module of claim 6, wherein said means for regulating the amount of microwave energy which reaches said antenna further includes means for moving said antenna with respect to said shield.

8. The module of claim 1, wherein said lamp is a high brightness point-source gas discharge lamp.

9. The module of claim 1, wherein said means for regulating includes:

a regulator circuit; and means connecting said antenna to said regulator circuit for regulating the current supplied to said lamp.

10. A microwave oven, comprising:

a housing;

a cooking cavity within said housing;

a microwave energy source directing microwaves of a predetermined wavelength into said cavity;

an access door in said housing leading to said cavity;

a low-voltage lamp module mounted entirely within said cavity and located adjacent to said access door and including a high brightness point source lamp to direct light into the cavity; and a source of regulated power including a microwave antenna for supplying current to said lamp.

11. The microwave oven of claim 10, wherein said lamp includes a filament having an effective length that is less than said predetermined wavelength to reduce induction of current in said filament by said microwaves.

12. The microwave oven of claim 11, wherein said filament has a length in the range of about 1/10 to 1/40 of said wavelength.

13. The microwave oven of claim 10, wherein said lamp includes a multisegmented filament, wherein adjacent segments are connected in opposition to reduce the induction of microwave energy into said lamp.

14. The microwave oven of claim 10, further including a lamp housing integral with said cavity and shaped to concentrate said light directly into said cavity.

15. The microwave oven of claim 10, wherein said microwave antenna is movable.

16. The microwave oven of claim 10, wherein said microwave antenna having movable arms, and an attenuating shield, said arms being movable with respect to said shield for regulating the power supplied to said lamp.

17. The microwave of claim 10, wherein said microwave antenna having first and second arms, and a bimetallic, heat sensitive element connected to each arm for adjusting the position of said arm in response to RF current flow in said element.

18. The oven of claim 10, wherein said lamp module is mounted to direct $4\pi$ steradians of light output from said lamp into said cavity.

* * * * *